US009617695B2

(12) United States Patent
Gencer

(10) Patent No.: US 9,617,695 B2
(45) Date of Patent: Apr. 11, 2017

(54) VERTICAL DRIER

(71) Applicant: Mehmet Nezir Gencer, Bursa (TR)

(72) Inventor: Mehmet Nezir Gencer, Bursa (TR)

(73) Assignees: E-MAK MAKINA INSAAT, Bursa (TR); TICARET VE SANAYI A.S., Bursa (TR)

( * ) Notice: Subject to any disclaimer, the term of this patent is extended or adjusted under 35 U.S.C. 154(b) by 811 days.

(21) Appl. No.: 13/967,951

(22) Filed: Aug. 15, 2013

(65) Prior Publication Data

US 2014/0090269 A1 Apr. 3, 2014

Related U.S. Application Data

(63) Continuation of application No. PCT/EP2012/061537, filed on Jun. 16, 2012.

(51) Int. Cl.

| | |
|---|---|
| ***F26B 21/00*** | (2006.01) |
| ***E01C 19/05*** | (2006.01) |
| ***F26B 17/00*** | (2006.01) |
| ***F26B 25/10*** | (2006.01) |

(52) U.S. Cl.

CPC ..... *E01C 19/05* (2013.01); *F26B 17/002* (2013.01); *F26B 25/10* (2013.01); *F26B 2200/06* (2013.01)

(58) Field of Classification Search

CPC ..... C08G 85/00; F26B 5/041; F26B 17/006; F26B 17/266; F26B 17/1475; F26B 17/122; F26B 25/002; F26B 21/00; C21D 9/005; E01C 19/1004; E01C 19/1063

USPC ..... 34/565

See application file for complete search history.

(56) References Cited

U.S. PATENT DOCUMENTS

| | | | | |
|---|---|---|---|---|
| 1,414,180 A * | 4/1922 | Collins | C21D 9/005 | 219/157 |
| 1,603,108 A * | 10/1926 | Heinz | F26B 17/1475 | 34/164 |
| 5,423,606 A * | 6/1995 | Milstead | E01C 19/1004 | 366/18 |
| 2002/0032971 A1* | 3/2002 | Middaugh | F26B 17/122 | 34/168 |

FOREIGN PATENT DOCUMENTS

| | | | | |
|---|---|---|---|---|
| GB | 1349466 A * | 4/1974 | C08G 85/00 | |

* cited by examiner

*Primary Examiner* — Jorge Pereiro
*Assistant Examiner* — Wes Anderson, Jr.
(74) *Attorney, Agent, or Firm* — Inventa Capital PLC

(57) ABSTRACT

The present invention is a vertical drier which dries the asphalt road upper structural members like aggregate and like asphalt coating which is desired to be recycled (RAP) and which takes the humidity of said asphalt road upper structural members; and which has a vertical body having an end through which said members are discharged and having another end which is opened to an accumulation compartment; and where the hot air, heated by a heat source, is transferred inside said body. Said drier is characterized by comprising at least one drying box which has a chamber form where the poured members are accumulated in the inner part thereof and which extends orthogonally to the flow direction inside the body; in order to keep the members, which pour inside said body from an inlet part, for certain duration and in order to transfer said members from the outlet part to the accumulation compartment step by step.

16 Claims, 4 Drawing Sheets

VERTICAL DRIER

CROSS-REFERENCE TO RELATED APPLICATION

This is a Continuation application of PCT Patent Application Serial No. PCT/EP2012/061537, filed Jun. 16, 2012, which claims the priority benefit of Turkey Patent Application TR2011/02917 filed on Apr. 18, 2011, which is hereby incorporated herein by reference.

TECHNICAL FIELD

The present invention relates to driers providing the drying of asphalt road upper structural members and particularly relates to vertical driers.

BACKGROUND

As known, there are pluralities of types of drier embodiments for providing the drying of materials. In general, said driers have a form so as to define a chamber, and hot air is applied inside the chambers; and products or objects are dried inside said chamber.

In the patent application TR2006/07503, a drier system is disclosed which is designed for drying legumes and cereals. Said system functions as follows: The humid product, which is entered to the tower from above, is poured to the cabinets at a certain speed downwardly and said product is heated by means of the vapor transferred to the cabinets and at the bottom cabinet, the product is cooled. The product flows through the gaps and moves downwardly. The product is discharged by the variator which is positioned at the bottom and which moves forwardly and backwardly, and the flow speed of the product is adjusted by the variator. The flow of the product is provided by means of the small gaps which are positioned between the gaps and which are positioned at the upper part of the variator. The air, used in the cabinet, is discharged by means of the suctioning pipes and the flow rate of the air is adjusted by means of the flaps and the pressure of the air is adjusted by means of the bushings.

The patent application TR2011/02838 discloses a recycling system which dries the RAP or aggregate and which takes the humidity in the RAP or aggregate. However, the drier mechanism of this system, requires some revisions.

SUMMARY

The present invention is a drier, which eliminates the abovementioned problems and which brings new advantages to the related technical field.

Another object of the present invention is to provide a drier which provides the RAP (Recycled Asphalt) and aggregate to be dried using less energy and to be dried in a more regular manner, in order to be used in new asphalt concrete production.

Another object of the present invention is to provide a system which brings the RAP and aggregate to the process temperature and which takes the humidity in the RAP or in the aggregate and which provides the RAP or aggregate to be dried.

In order to realize all of the abovementioned objects, the present invention is a vertical drier which dries the asphalt road upper structural members and which takes the humidity of said asphalt road upper structural members; and which has a vertical body having an end through which said members are discharged and having another end which is opened to an accumulation compartment; and where the hot air, heated by a heat source, is transferred inside said body. Said vertical drier is characterized by comprising at least one drying box which has a chamber form where the poured members are accumulated in the inner part thereof and which extends orthogonally to the flow direction inside the body; in order to keep the members, which pour inside said body from an inlet part, for certain duration and in order to transfer said members from the outlet part to the accumulation compartment step by step.

In a preferred embodiment of the subject matter invention, said drying boxes are connected inside the drier body from the middle part thereof so as to move in the pouring direction around a shaft.

In another preferred embodiment of the subject matter invention, there is a drive member driving the shaft, in order to partially rotate the drying boxes on the first line in the pouring direction and in order to bring said drying boxes from the waiting position to the pouring position or in order to bring said drying boxes from the pouring position to the waiting position.

In another preferred embodiment of the subject matter invention, there is a drive member driving the shaft, in order to partially rotate the drying boxes on the second line in the pouring direction and in order to bring said drying boxes from the waiting position to the pouring position or in order to bring said drying boxes from the pouring position to the waiting position.

In another preferred embodiment of the subject matter invention, said drying box comprises pluralities of openings on the base part through which hot air can pass and through which the poured members cannot pass.

In another preferred embodiment of the subject matter invention, the drying box comprises openings on the back part thereof through which air can pass.

In another preferred embodiment of the subject matter invention, said drying boxes are sequenced one under the other on the drier's first line and second line so that at least some parts thereof will coincide in the vertical plane inside the drier.

In another preferred embodiment of the subject matter invention, said drying boxes are sequenced one under the other on the first line of the drier.

In another preferred embodiment of the subject matter invention, said drying boxes are positioned one under the other on the second line so as to correspond between the drying boxes which are positioned one under the other on the first line.

In another preferred embodiment of the subject matter invention, there is a sensor which measures the temperature of the mixture which exits from said drier and which is accumulated in the accumulation compartment.

In another preferred embodiment of the subject matter invention, there is a control unit which adjusts the resting duration of the drying box in the waiting position and thereby which provides the RAP to be heated more or less, according to the temperature value taken from the sensor.

In another preferred embodiment of the subject matter invention, there is also a second base part which extends parallel to the base part on the drying box's base part and which has openings thereon.

In another preferred embodiment of the subject matter invention, the second base part extends up to the middle of the first base part.

In another preferred embodiment of the subject matter invention, there is at least one comb group which has teeth entering between the openings in order to remove the members accumulated between said openings.

In another preferred embodiment of the subject matter invention, there is a second comb group which has teeth entering between the openings on the second base part.

In another preferred embodiment of the subject matter invention, there is a rotary valve which provides pouring of the RAP from the RAP depot into the drier without taking cold air inside and in a controllable manner.

In another preferred embodiment of the subject matter invention, said rotary valve comprises a RAP inlet compartment facing the RAP depot; and a RAP outlet compartment facing the pouring chamber.

In another preferred embodiment of the subject matter invention, the air-tightness of said drier body is provided.

In another preferred embodiment of the subject matter invention, it is adapted to an asphalt plant.

In order for the embodiment and the advantages of the subject matter invention to be understood in the best manner with the additional elements, it has to be evaluated with the figures explained below.

DETAILED DESCRIPTION OF EXAMPLE EMBODIMENTS

In this detailed description, the subject matter vertical drier (20) embodiment is explained with references to the annexed figures without forming any restrictive effect in order to make the subject more understandable. The subject matter vertical drier (20) is assumed to be applied to an asphalt plant (10) and it is assumed to be used in drying of aggregate and recycled asphalt concrete (hereafter, it will be called RAP), however, with minor revisions, the subject matter invention can also be used in drying of cereal products like wheat and drying of other products in granule form.

Figure 1:
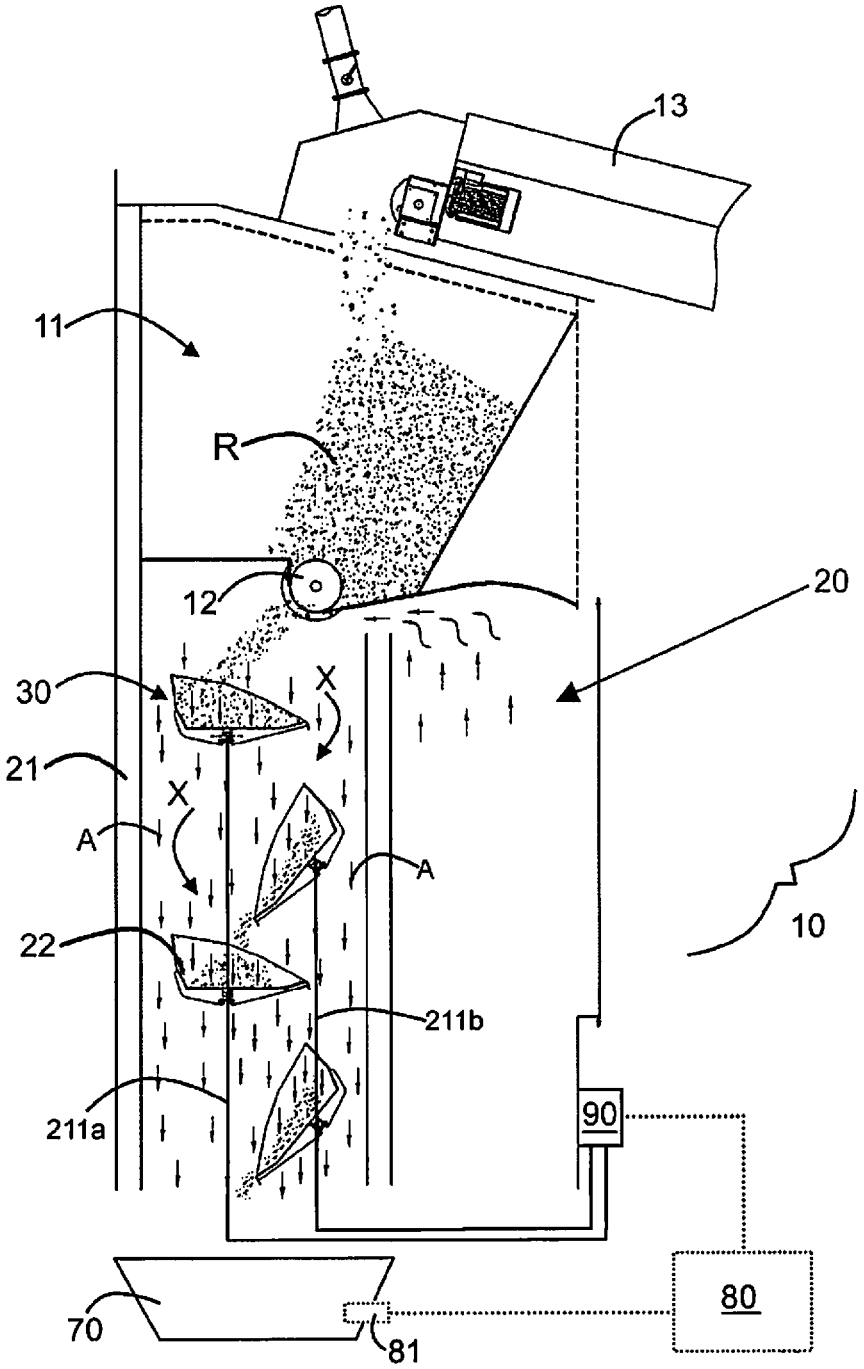
In FIG. 1, a representative view of the subject matter drier is given.

With reference to FIG. 1, the subject matter vertical drier (20) comprises a rectangular prism like body extending vertically. The RAP or the aggregate, existing in the RAP silo and in the aggregate silo (not illustrated in the figure), is carried by a conveyor (13) and it is poured downwardly to the drier (20) through an inlet part in the vertical direction. The drier (20) extends vertically upwardly from an accumulation compartment (70) where the dried RAP or the aggregate is accumulated. The RAP and the aggregate, which is emptied into the drier (20) from the inlet part, are accumulated in the accumulation compartment (70) through the outlet part. The drier (20) is preferably in the form of a rectangular prism, however, in the alternative embodiment, it can also have a cylindrical form. The RAP or the aggregate, which is to be dried, is poured from the drier (20) into the accumulation compartment (70) in a controllable manner and so as to wait for certain time duration. In order to provide this, there are drying boxes (30) positioned inside the drier (20). Said drying boxes (30) have a basket like form; and they comprise a chamber form (34) wherein the RAP or the aggregate can accumulate. The drying boxes (30) are sequenced inside the drier (20) so as to be mutual and one above the other, in the distance from the upper part of the body (21) to the accumulation compartment (70). The drying boxes (30) existing on the body's (21) first line (211*a*) and the second line (211*b*) are sequenced so that some parts coincide in the vertical plane. Some parts of the drying box (30), existing on the first line (211*a*), coincide with some parts of the drying box (30) positioned on the second line (211*b*) which is below the first line (211*a*). When the RAP or the aggregate is poured into the drier (20) from the upper part thereof, it fills inside the chamber (34) of the drying box (30). After certain time duration, the drying box (30) is turned in the pouring direction (X) as required, the RAP or the aggregate, which exists inside, is poured into the drying box (30) chamber (34) existing at the lower part. Afterwards, the drying box (30), whereon RAP or aggregate is poured, is turned in the pouring direction (X) after certain time duration; and the RAP, existing inside the chamber (34), is poured to the chamber (34) of the drying box (30) existing at the lower part. The RAP or the aggregate continues these processes in an ordered manner and they finally reach the accumulation compartment (70). The drying boxes (30) exist one under the other on the first line (211*a*) of the drier (20). In the same manner, they are sequenced on the first line (211*a*) so as to correspond between the drying boxes (30) which are positioned one under the other, and the waiting members are sequenced on the second line (211*b*) so as to be one under the other. Firstly, the drying boxes (30) on the first line (211*a*) exist in the waiting position. Afterwards, the drying boxes (30) on the first line (211*a*) are turned in the pouring direction (X) by means of a drive member (90) and the drying boxes (30) take the pouring position. The drying boxes (30) are connected onto a shaft (60) by means of a hinge from the middle points thereof on the first line (211*a*). When a force is applied to the shaft (60) by means of the drive member (90), the shaft (60) rotates in the pouring direction (X). The RAP, existing inside the drying boxes (30), is poured into the chamber of the drying boxes (30) which exist in the waiting position and which are sequenced on the second line (211*b*). As a result, the drying boxes (30) on the second line (211*b*) are turned as required from the waiting position to the pouring position. In this case, the RAP or the aggregate, which exists inside the chamber (34) of the drying boxes (30) existing on the second line (211*b*), is poured to the chamber (34) of the drying boxes (30) existing in waiting position on the first line (211*a*). By means of this, the RAP or the aggregate passes from the drying boxes (30), which are sequenced on the first line (211*a*), to the drying boxes (30) which are sequenced on the second line (211*b*), and afterwards, the RAP or the aggregate passes from the drying boxes (30), which exist on the second line (211*b*), to the drying boxes (30) on the first line (211*a*); and it advances to the accumulation compartment (70) in an ordered manner.

Figure 2A:
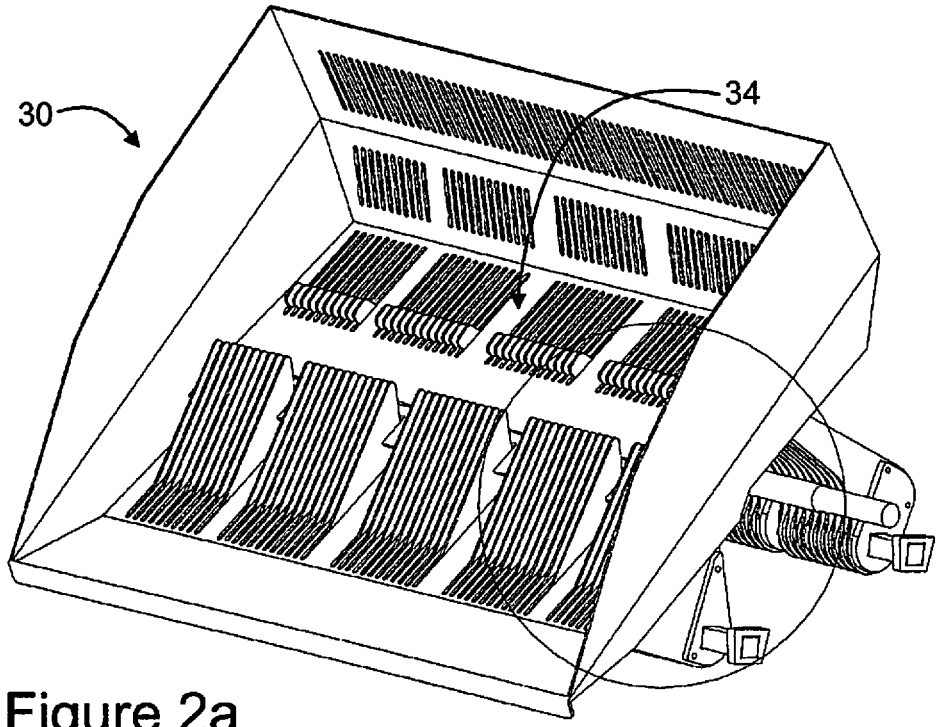
In FIG. 2*a*, the top perspective view of a waiting member is given.
Figure 2B:
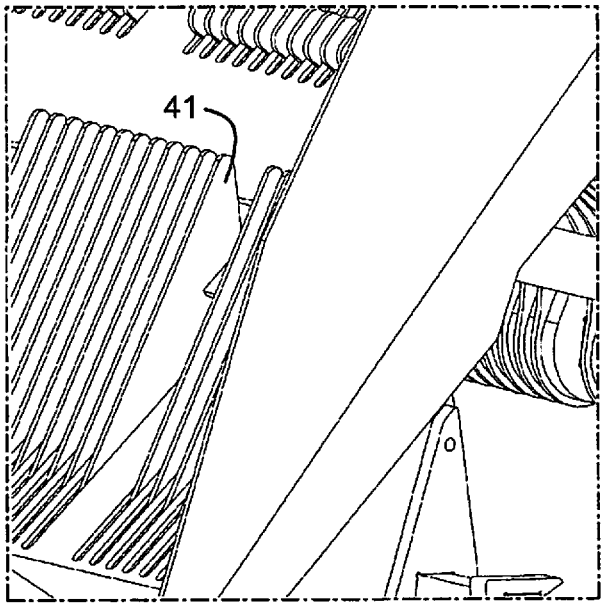
In FIG. 2*b*, the detailed view of the view given in FIG. 2*a* is given.
Figure 3A:
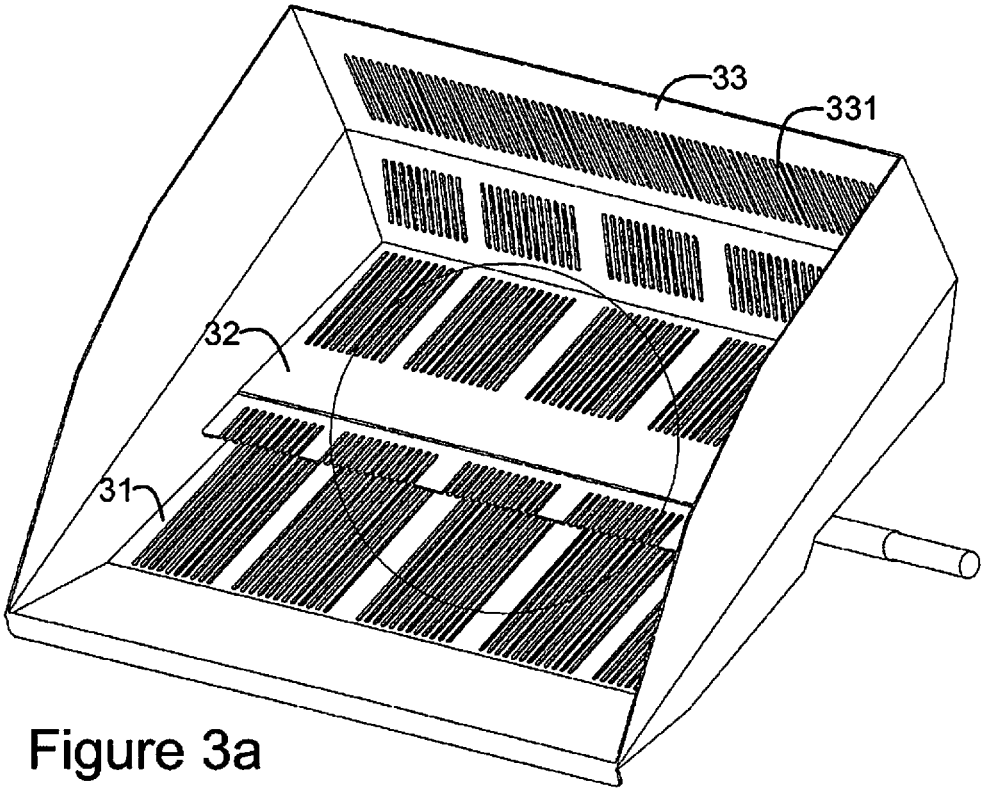
In FIG. 3*a*, the perspective view of the waiting member is given from another perspective.
Figure 3B:
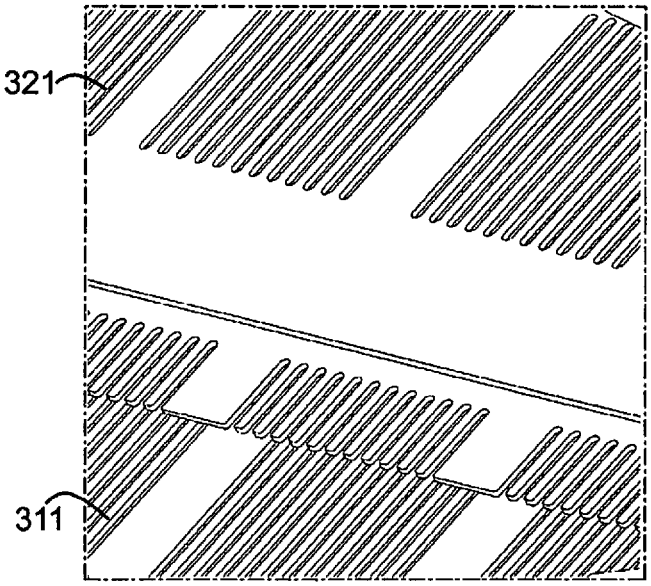
In FIG. 3*b*, the detailed view of the view illustrated in FIG. 3*a* is given.
Figure 4A:
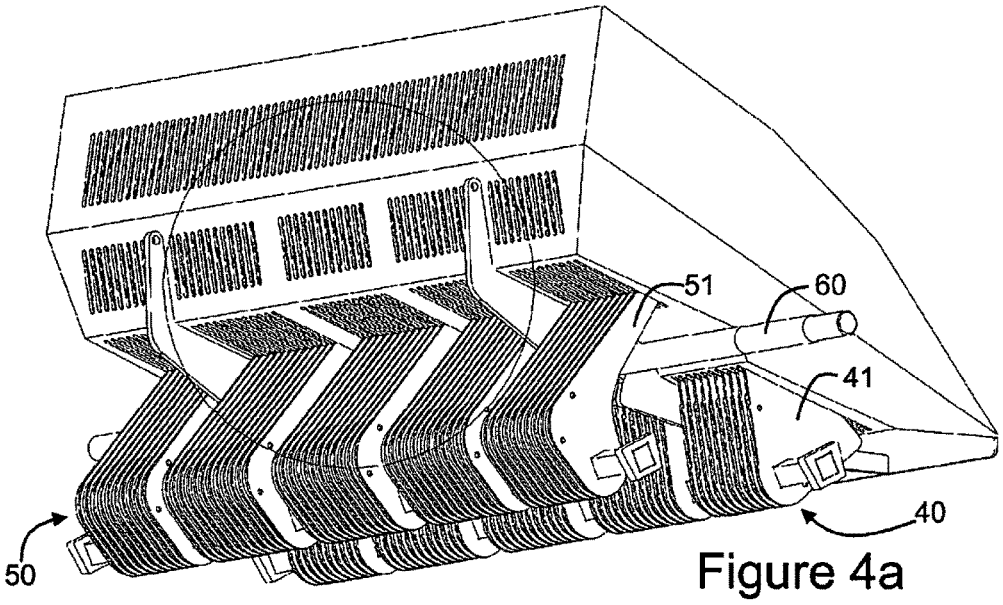
In FIG. 4*a*, the bottom perspective view of the waiting member is given.
Figure 4B:
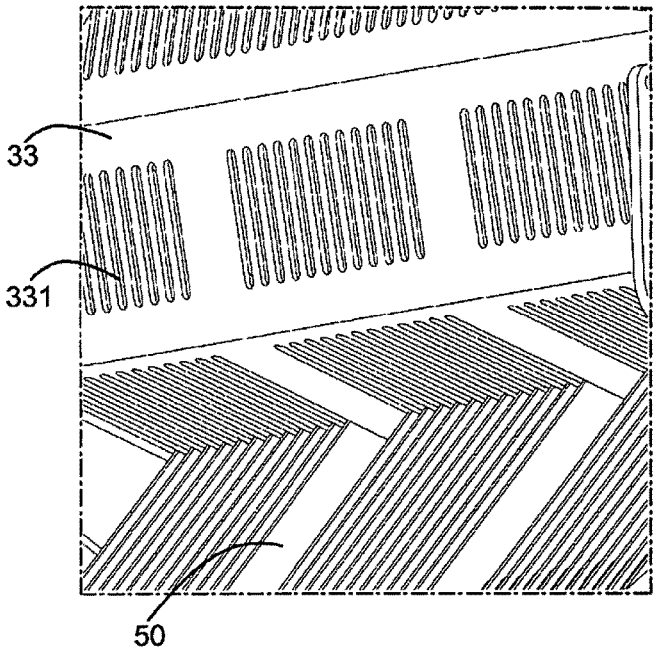
In FIG. 4*b*, the detailed view of the view illustrated in FIG. 4*a* is given.

With reference to FIGS. 2*a* and 2*b*, on the base part (31) of the drying box (30), there are pluralities of openings (311) through which the hot air can pass. After RAP or aggregate is poured to the chamber (34) of the drying box (30), hot air is passed through said openings (311) in the flow direction. Since the RAP or the aggregate closes said openings (311), hot air will pass through the holes in a slower manner. By means of this, the RAP or the aggregate will be heated more. There are openings (331) also on the back part (33) of the waiting member (30). The hot air passes through the openings (331) on said back part (33), and it advances inside the drier (20) in an easy manner. When the RAP, existing inside the drying box (30), is poured to the drying box (30) existing at the bottom, RAP or aggregate can enter between the openings (311) of the drying box (30). For removing the RAP or aggregate, which enters between the openings (311), there is a comb group (40) with teeth (41) entering into said openings (311). As can be seen in FIGS. 4*a* and 4*b*, when the drying box (30) passes from the waiting position to the pouring position, said teeth (41) enter between the openings (311), and the RAP is removed from these openings. The number of teeth (41) in the comb group (40) is equal to the number of openings (311) existing on the base part (31) of the drying box (30). The comb group (40) preferably stays fixed. However, in the alternative embodiment, the movement of the comb group can also be provided by means of a drive unit.

On the base part (31) of the drying box (30), there is also a second base part (32) which extends in a parallel manner to the base part (31). On the second base part (32), there are openings (321) similar to the openings (311) on the base part (31). There is also a second comb group (50), which enters said openings (321). When the drying box (30) arrives at the pouring position from the waiting position, the second comb group (50) enters into the openings on the second base part (32). In a similar manner, the second comb group (50) comprises pluralities of teeth (51) which enter said openings (321).

In order to discharge the RAP into the drier (20) in a controlled manner, the RAP is transferred to the RAP depot (11) from the conveyor (13). The RAP depot (11) is positioned on the drier (20). The RAP is transferred to the RAP depot (11) and afterwards, from here, it is poured inside the drier (20). There is a rotary valve (12) which provides the RAP to flow from the RAP depot (11) towards the drier (20) and which prevents said flow. The rotary valve (12) preferably has 5 compartments. The RAP, flowing from the conveyor (13), fills in the compartments of the valve in sequence. While the rotary valve (12) rotates around the own axis thereof, the RAP, which fills in the compartments, is transferred inside the drier (20) in sequence. By means of this, for instance, when the drying boxes (30) existing on the first line (211*a*) are in waiting position, RAP flows to the drying boxes (30) from the compartment of the rotary valve (12). Afterwards, when the drying boxes (30) are in pouring position, the rotary valve (12) rotates as required, the inlet part of the RAP depot (11) is closed and thus the RAP does not flow. Thanks to the rotary valve (12), when the drying boxes (30) are in pouring position, the RAP flow from the RAP depot (11) is prevented.

There is a sensor (81) which measures the temperature of the RAP and of the aggregate accumulated in the accumulation compartment (70). Said sensor (81) is in connection with a control unit (80). The control unit (80) adjusts the waiting duration of the drying boxes (30) in the waiting position, according to the temperature of the mixture in the mixture chamber. For instance, if the temperature of the mixture is not at the desired temperature value, the drying boxes (30) stay in the waiting position for longer time duration. Thus, optimum temperature value is provided.

Hot air is applied inside the drier (20) from a heat source. Said hot air can be hot waste exhaust gas; or said hot air can be provided from the hot air formed inside the drier thanks to a burner or a separate air source existing in the asphalt plant. In order to provide the hot air applied inside the drier (20) to advance inside the drier (20), the air is drawn by vacuum from the bottom of the drier (20). Thanks to this, the hot air advances inside the drier (20) by passing from inside, from the above and from the sides of the drying boxes (30) and from every point inside the whole drier (20).

By means of the vertical drier (20) described above, less space is occupied and minimum energy is consumed and both the aggregate and the RAP are brought to the process temperature and the humidity inside is taken.

What is claimed is:

1. A vertical drier which dries asphalt road upper structural members like aggregate and like asphalt coating which is desired to be recycled (RAP) and which takes the humidity of said asphalt road upper structural members comprising: a vertical body having an end through which said members are discharged and having another end which is opened to an accumulation compartment, the vertical drier comprising at least one drying box which has a pair of base parts with one of the base parts extending in the middle of the other of said base parts, a chamber form where the poured members are accumulated in the inner part thereof and which extends orthogonally to the flow direction inside the body; in order to keep tire members, which pour inside said body from an inlet part, for certain duration and in order to transfer said members from an outlet part to the accumulation compartment step by step; wherein one of said base parts is also a second base part which extends parallel to a first base part on the drying box's base part and which has openings thereon; and characterized in that the second base part extends up to the middle of the first base part.

2. A vertical drier according to claim 1, characterized in that said drying boxes are connected inside a drier body from the middle part thereof so as to move in the pouring direction (X) around a shaft.

3. A vertical drier according to claim 2, characterized in that there is a drive member driving the shaft, in order to partially rotate the drying boxes on a first line in the pouring direction (X) and in order to bring said drying boxes from the waiting position to the pouring position or in order to bring said drying boxes from the pouring position to the waiting position.

4. A vertical drier according to claim 2, characterized in that there is another drive member driving the shaft, in order to partially rotate the drying boxes on a second line in the pouring direction (X) and in order to bring said drying boxes from the waiting position to the pouring position or in order to bring said drying boxes from the pouring position to the waiting position.

5. A vertical drier according to claim 1, characterized in that said drying box comprises pluralities of openings on one of the base part through which hot air can pass and through which the poured members cannot pass.

6. A vertical drier according to claim 1, characterized in that the drying box comprises openings on a back part thereof through which air can pass.

7. A vertical drier according to claim 1, characterized in that said drying boxes are sequenced one under the other on the drier's first line and second line so that at least some parts thereof will coincide in the vertical plane inside the drier.

8. A vertical drier according to claim 7, characterized in that said drying boxes are sequenced one under the other on the first line of the drier.

9. A vertical drier according to claim 8, characterized in that said drying boxes are positioned one under the other on the second line so as to correspond between the drying boxes which are positioned one under the other on the first line.

10. A vertical drier according to claim 1, characterized in that there is a sensor which measures the temperature of the mixture which exits from said drier and which is accumulated in the accumulation compartment.

11. A vertical drier according to claim 1, characterized in that there is a control unit which adjusts the resting duration of the drying box in the waiting position and thereby which provides the RAP to be heated more or less, according to the temperature value taken from the sensor.

12. A vertical drier according to claim 1, characterized in that there is at least one comb group which has teeth entering between the openings in order to remove the members accumulated between said openings.

13. A vertical drier according to claim 1, characterized in that there is a second comb group which has teeth entering between the openings on the second base part.

14. A vertical drier according to claim 1, characterized in that there is a rotary valve which provides pouring of a RAP from the RAP depot into the drier without taking cold air inside and in a controllable manner.

15. A vertical drier according to claim 14, characterized in that said rotary valve comprises a RAP inlet compartment facing the RAP depot; and a RAP outlet compartment facing the pouring chamber.

16. A vertical drier according to claim 1, characterized in that the drier is adapted to an asphalt plant.

* * * * *